US007118082B2

(12) United States Patent
Brnjac

(10) Patent No.: US 7,118,082 B2
(45) Date of Patent: Oct. 10, 2006

(54) RETRACTABLE HOOK ASSEMBLY FOR MOUNTING ON A SURFACE

(76) Inventor: Steve Brnjac, 400 Bloor Street East, Unit 58, Mississauga, Ontario (CA) L5A 3M8

( * ) Notice: Subject to any disclaimer, the term of this patent is extended or adjusted under 35 U.S.C. 154(b) by 263 days.

(21) Appl. No.: 10/667,422

(22) Filed: Sep. 23, 2003

(65) Prior Publication Data

US 2005/0061940 A1 Mar. 24, 2005

(51) Int. Cl.
*F16B 45/00* (2006.01)

(52) U.S. Cl. ..... 248/308; 248/691; 211/106.01

(58) Field of Classification Search ..... 248/308, 248/304, 306, 305, 317, 339, 691, 692; 24/601.5, 24/305, 308; 211/106.01, 99, 100, 171
See application file for complete search history.

(56) References Cited

U.S. PATENT DOCUMENTS

| | | | | |
|---|---|---|---|---|
| 1,461,938 | A * | 7/1923 | Rose | 248/294.1 |
| 2,071,257 | A * | 2/1937 | Hansen | 248/294.1 |
| 2,077,629 | A * | 4/1937 | Lahr | 248/294.1 |
| 2,500,881 | A * | 3/1950 | Stader | 211/85.3 |
| 2,602,622 | A * | 7/1952 | Smith | 248/291.1 |
| 2,706,049 | A * | 4/1955 | Andrews | 224/482 |
| 3,941,250 | A * | 3/1976 | Ott | 211/1.3 |
| 4,221,354 | A * | 9/1980 | Kempkers | 248/291.1 |
| 4,787,590 | A * | 11/1988 | Melvin | 248/291.1 |
| 6,109,579 | A * | 8/2000 | Huang | 248/294.1 |
| 6,663,067 | B1 * | 12/2003 | Gordon | 248/294.1 |
| 6,698,695 | B1 * | 3/2004 | Spoto | 248/95 |
| 6,968,601 | B1 * | 11/2005 | Bivens et al. | 24/369 |
| 2003/0141423 | A1 * | 7/2003 | Gordon | 248/304 |
| 2004/0104325 | A1 * | 6/2004 | Ay | 248/308 |

* cited by examiner

*Primary Examiner*—A. Joseph Wujciak, III
(74) *Attorney, Agent, or Firm*—Miller Thomson LLP

(57) ABSTRACT

A retractable hook assembly for mounting on a surface including a bracket member having front side with a retracting groove and at least one positioning channel. The assembly also includes a back side adapted for mounting on the surface, and a hook member having a proximal end and a distal end. The proximal end may have at least one projection adapted to engage the positioning channel when the hook member is in an extended position. The front side of the bracket member may be adapted to receive the hook member into the retracting groove when in a retracted position thereby concealing the hook member.

19 Claims, 4 Drawing Sheets

RETRACTABLE HOOK ASSEMBLY FOR MOUNTING ON A SURFACE

FIELD OF THE INVENTION

This invention relates in general to a support or hook and more particularly to a hook assembly that is retractable so as to be concealed and can be mounted to a surface such as a wall.

BACKGROUND OF THE INVENTION

There are a wide variety of supports or hooks available, but these traditional hooks are often unattractive and project a way from the surface that they are mounted on. More specifically these hooks can either cause damage to other surfaces when other objects or surfaces bump into the hooks. For example, a hook projecting from the wall behind a door can often protrude a significant distance so that if a door is opened it can swing back and hit the hook thereby damaging the door. Protruding hooks can also result in injury if someone knocks into them.

Prior art supports or hooks have been devised to address the noted problems. For example, U.S. Pat. No. 6,109,579 issued on Aug. 29, 2000 to Huang relates to an a hook device which includes a panel having a compartment defined therein. A hook includes a first section pivotally connected to the panel and a second hooked section removably received in the compartment. An elastic member is provided for moving the second hooked section of the hook outside of the compartment. A push button is provided for releasably retaining the second hooked section of the hook in the compartment.

Harris is the owner of U.S. Pat. No. 5,950,845, which issued on Sep. 14, 1999. This patent relates to flush, mountable valet having a hanger arm and a support arm. The hanger arm and support arm are retained within a longitudinal channel extending the length of the valet housing. A flat or flush profile is achieved.

Ott is the owner of U.S. Pat. No. 3,941,250, which issued on Mar. 12, 1976. This patent relates to a foldable support, adapted to be mounted on a vertical wall which includes an elongated vertical housing, and an arm having an end portion pivotally mounted on a lower portion of the housing and adapted to be selectively moved between a raised position at which the arm is concealed within the housing, and a lowered position at which the arm projects horizontally outwardly therefrom. The housing has a channel-shaped transverse cross-section formed by a pair of transversely-spaced vertical flanges separated by an intermediate vertical web. The pivoted end portion of the arm has a U-shaped cross-section provided with a pair of trunnions which are journalled in a pair of bearing openings provided in the housing. When the arm is moved to the lowered position, an object, such as a clothes hanger, may be hung therefrom.

Thus a hook assembly that is retractable when not in use so as to not cause injury, is attractive when mounted so as to fit in with home decor, can hold a significant amount of weight, and conceals the hook when not in use is desirable.

SUMMARY OF THE INVENTION

An object of one aspect of the present invention is to provide an improved retractable hook assembly for mounting on a surface.

In accordance with one aspect of the present invention there is provided a retractable hook assembly for mounting on a surface including a bracket member having front side with a retracting groove and at least one positioning channel. The assembly also includes a back side adapted for mounting on the surface, and a hook member having a proximal end and a distal end located on the front side of the bracket member. The proximal end may have at least one projection adapted to engage the positioning channel when the hook member is in an extended position. The front side of the bracket member may be adapted to receive the hook member into the retracting groove when in a retracted position thereby concealing the hook member.

Conveniently, the positioning channel has a top side and a bottom side thereby providing a cam surface. The projection is a cam whereby the cam engages the top side or cam surface of the positioning channel when the hook member is in the extended position, and the cam engages the bottom side or cam surface when the hook member is in the retracted position.

Preferably, the retracting groove has two sides and has two positioning channels located on either side of the retracting groove. The hook member may be an arm having two sides, a front side and back side. The hook member may also include two cams on either side of the arm to engage the two positioning channels. The cams may therefore engage the top sides of the positioning channels allowing the arm to extend to a maximum of 45°.

Advantages of the present invention are: the retractable hook assembly can retract when not in use into the bracket member so as to conceal the hook when not in use, thereby preventing injury while providing a pleasing exterior to a home decor or the like; can support significant weight so as to accept a variety of articles; can include a graphic on the front side so as to appear as an ornament or like a plate covering for a power receptacle.

BRIEF DESCRIPTION OF THE DRAWINGS

A detailed description of the preferred embodiments are provided herein below by way of example only and with reference to the following drawings, in which.

Figure 2:
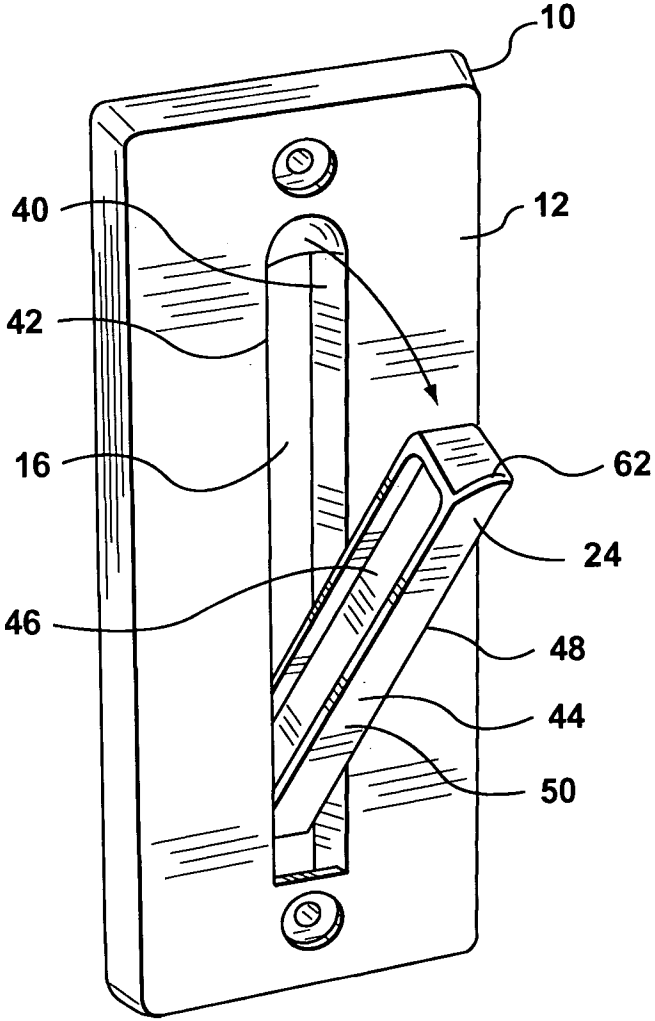
FIG. 2 in a perspective view, illustrates the retractable hook assembly of FIG. 1 in an extended position.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Figure 1:
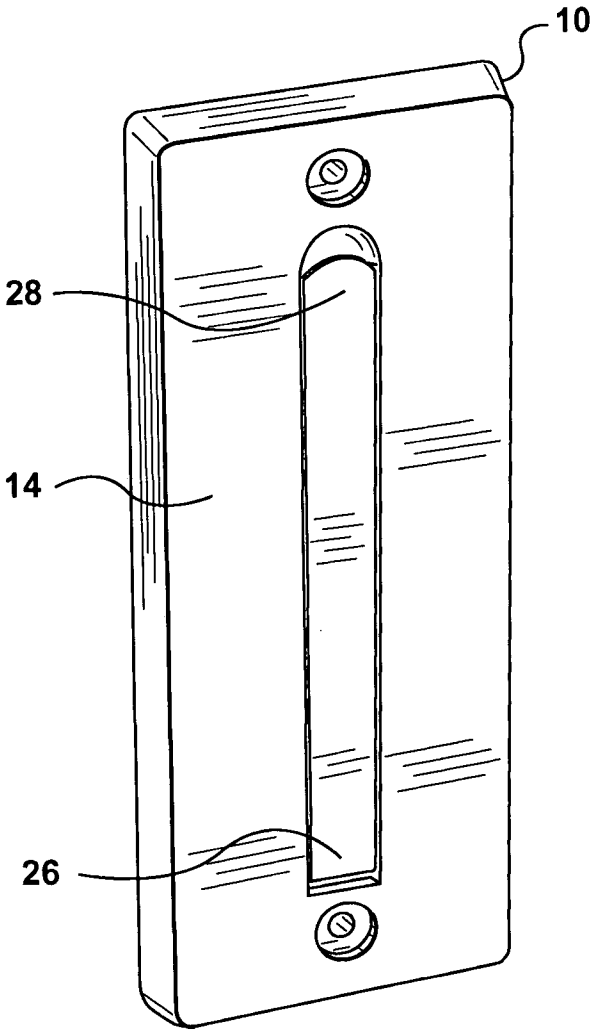
FIG. 1 in a front perspective view, illustrates a retractable hook assembly in the retracted position in accordance with a preferred embodiment of the present invention.
Figure 4:
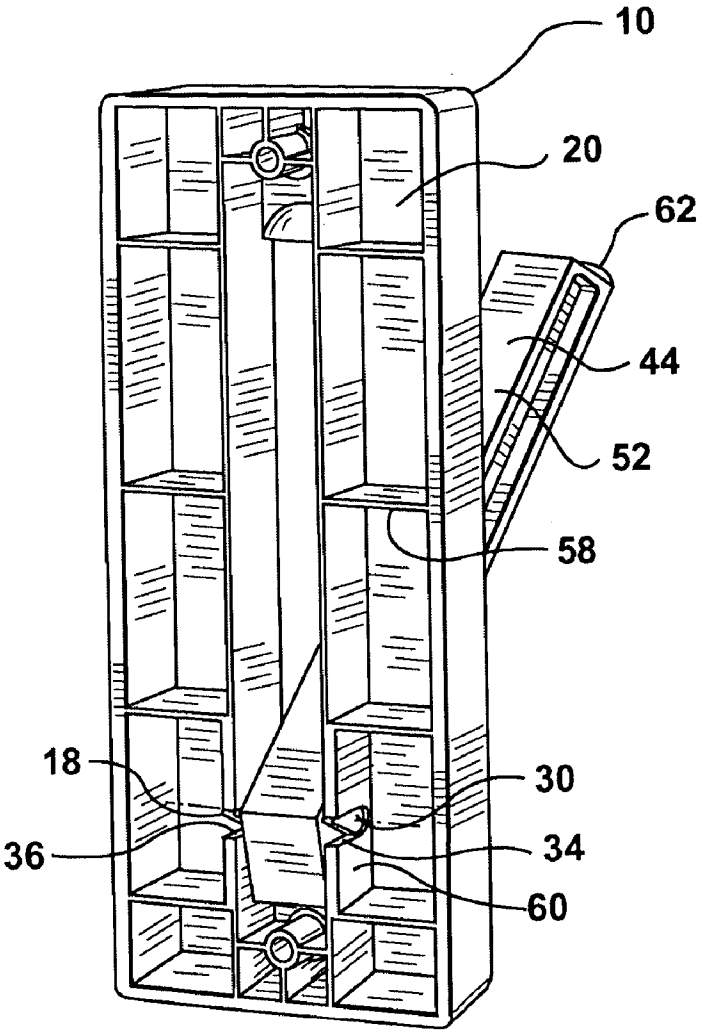
FIG. 4 in a back perspective view, illustrates the retractable hook assembly of FIG. 2.
Figure 3:
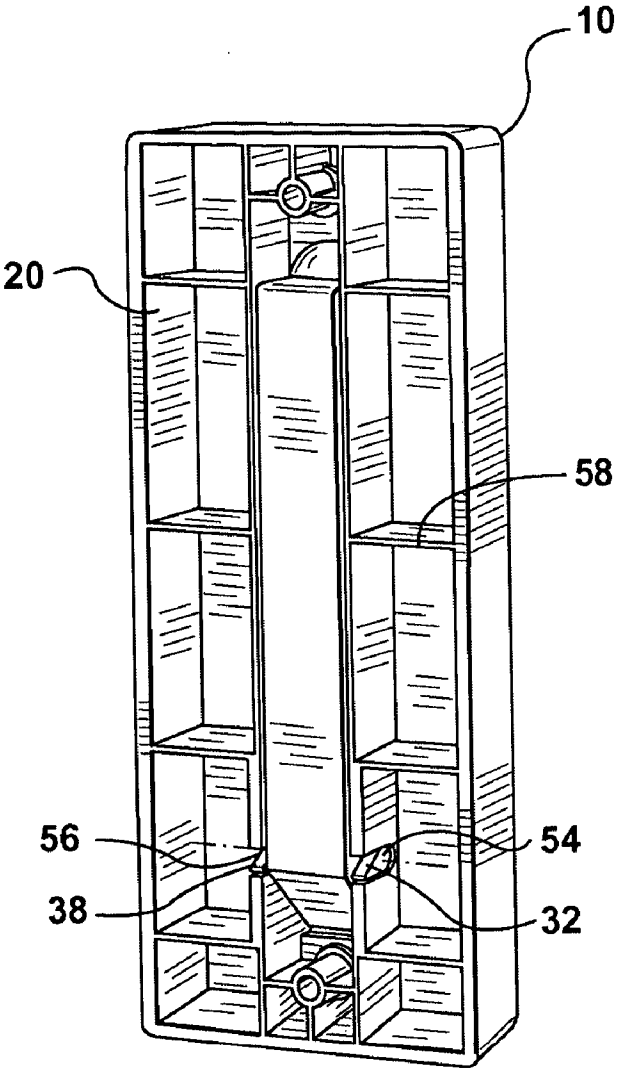
FIG. 3 in a back perspective view, illustrates the retractable hook assembly of FIG. 1.
Figure 5:
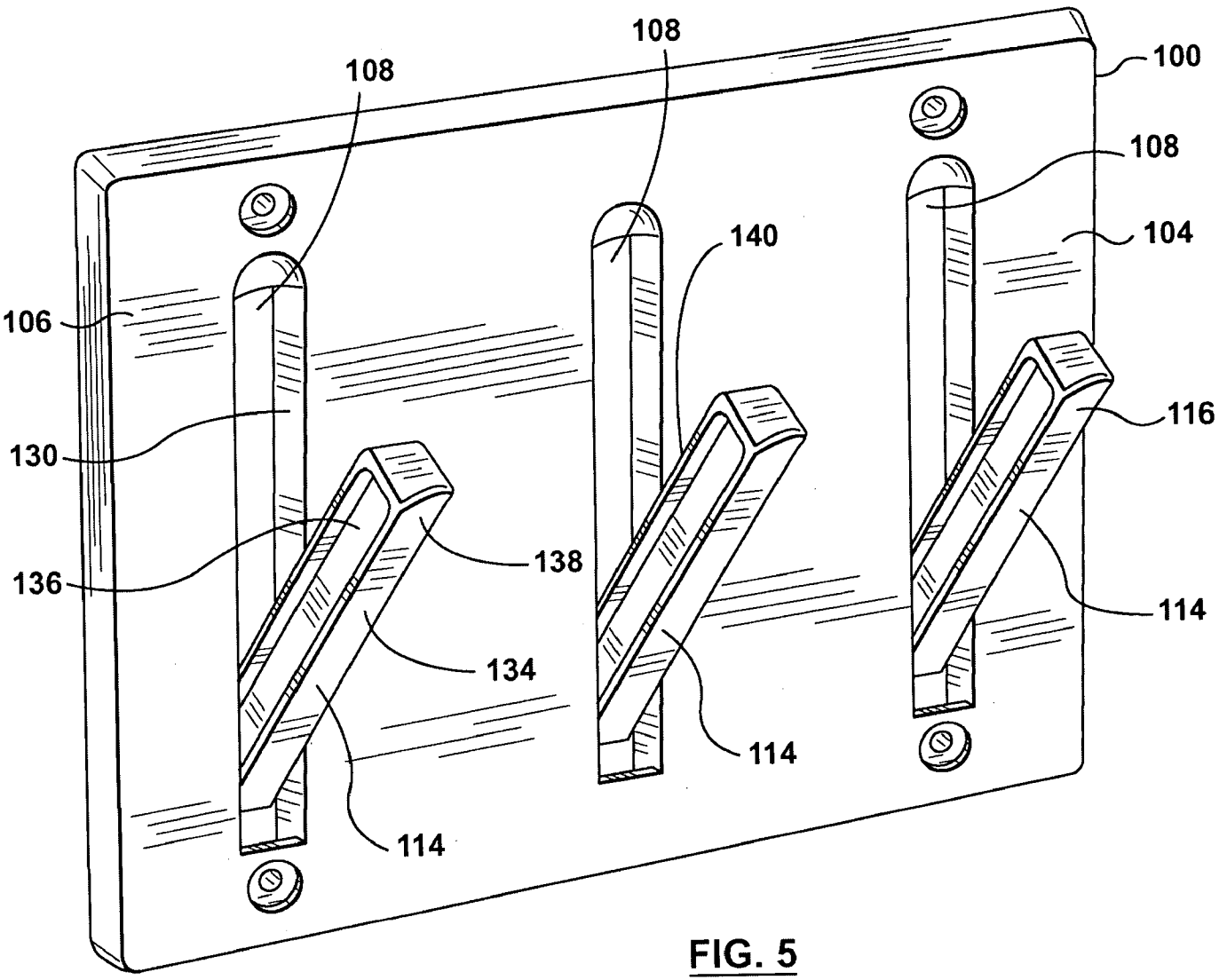
FIG. 5 in a front perspective view, illustrates a retractable hook assembly in accordance with a second preferred embodiment of the present invention.
Figure 6:
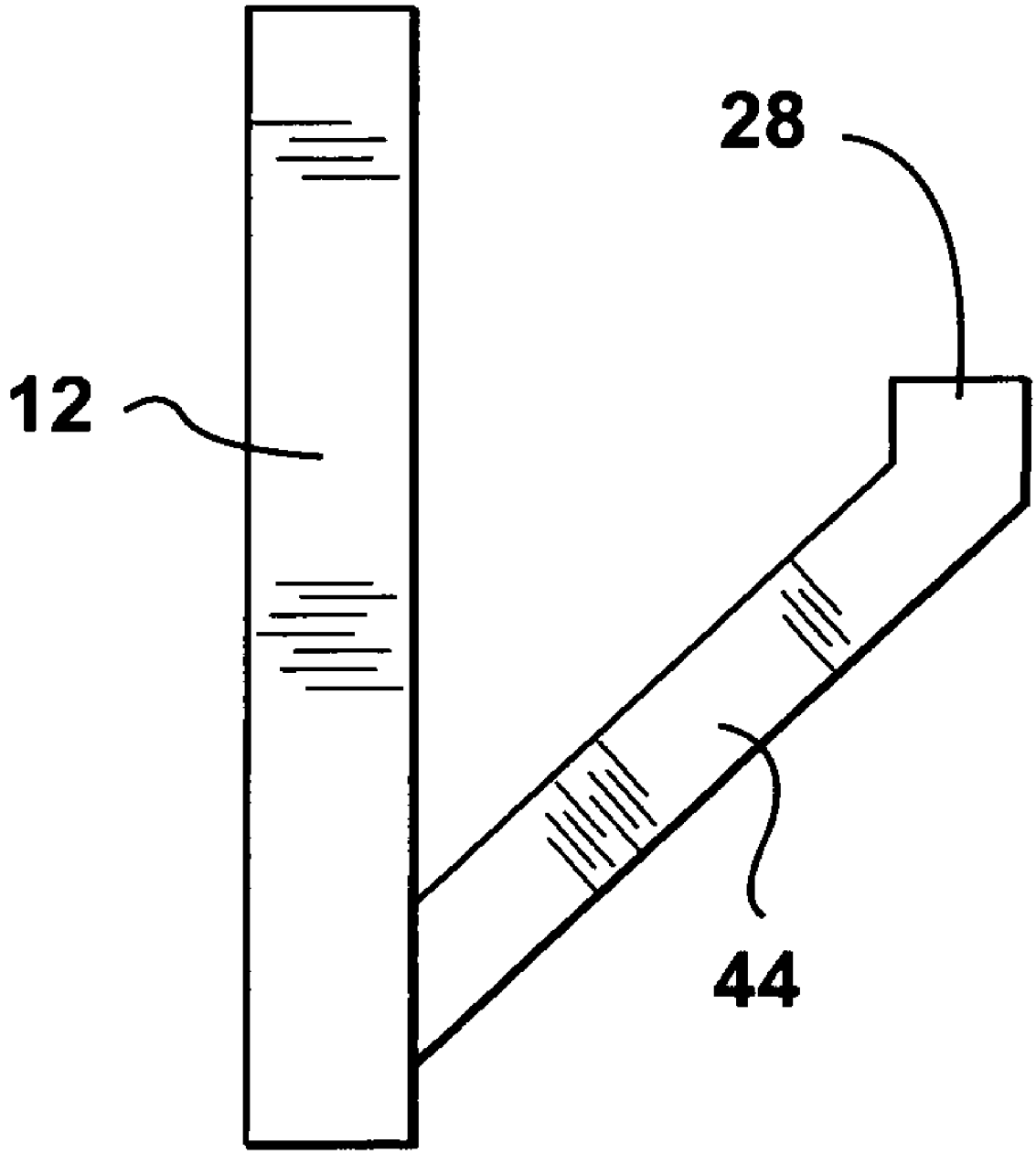
FIG. 6 in a perspective view, illustrates the hook shaped end of the distal end of the arm of the retractable hook assembly.

Referring to FIGS. 1 to 4, there is illustrated in front and back perspective views, a retractable hook assembly 10 for mounting on a surface in accordance with a preferred embodiment of the present invention. The retractable hook assembly 10 includes a bracket member 12 having front side 14 with a retracting groove 16 and at least one positioning channel 18. The bracket member 12 of the retractable hook assembly 10 also includes a back side 20 adapted for mounting on the surface (not shown). The bracket member 12 a hook member 24 having a proximal end 26 and a distal end 28.

The proximal end 26 may have at least one projection 30 adapted to engage the positioning channel 18 when the hook member 24 is in an extended position. The front side 14 of the bracket member 12 may be adapted to receive the hook member 24 into the retracting groove 16 when in a retracted position thereby concealing the hook member 24.

The positioning channel 18 may have a top side 32 and bottom side 34 providing a cam surface 36. The projection 30 may be a cam 38 whereby the cam 38 engages the top side 32 or cam surface 36 of the positioning channel 18 when the hook member 24 is in the extended position, and the cam 38 engages the bottom side 34 or cam surface 36 when the hook member 24 is in the retracted position.

The retracting groove 16 may have two sides 40 and 42 and have two positioning channels 18 located on either side 40 and 42 of the retracting groove 16. The hook member 24 may be further defined as an arm 44 having two sides 46 and 48, a front side 50 and back side 52, and has two cams 54 and 56 on either side 46 and 48 of the arm 44 to engage the two positioning channels 18.

When the arm 44 is in the extended position, the cams 54 and 56 engage the top sides 32 of the positioning channels 18 thereby allowing the arm 44 to extend to a maximum of 45°.

The back side 20 of the bracket member 12 may further comprise of a series of ribs 58 that can provide additional strength to the bracket member 12. Additional ribs 60 may also be included to help form the positioning channels 18 and therefore the cam surfaces 36 which then engage and restricting the cams 54 and 56 when in either the extended or retracted positions. The retractable hook assembly 10 may hold up to 35 pounds, though it can comfortably accommodate 25 pounds of material on the arm 44.

The distal end 28 of the hook member 34 or arm 44 may be adapted to receive a user's finger thereby allowing the user to easily grasp the arm 44 and extend the arm 44 into the extended position. The distal end 28 of the arm 44 may be further defined as having a pull tab 62 shaped to accommodate the user's finger.

The front side 14 of the bracket member 12 and the front side 50 of the arm 44 may further include a graphic that is visible when the retractable hook assembly 10 is in the retracted position and the arm 44 is concealed. The graphic may be designed to match a variety of home decors. The retractable hook assembly 10 may be manufactured from plastic, resin, wood, metal or composite material. Furthermore the surface 22 that the retractable hook assembly 10 may be mounted on may include a wall, door or other vertical surface.

In an other preferred embodiment of the present invention the distal end 28 of the arm 44 may be hook shaped thereby being parallel to the bracket member 12 when the arm 44 is in the extended position.

In a second preferred embodiment of the present invention, there is disclosed a retractable hook assembly 100 for mounting on a surface (not shown), including a bracket member 104 having a front side 106 with multiple retracting grooves 108 having at least one positioning channel (not shown), and a back side (not shown) adapted for mounting on the surface. The retractable hook assembly 100 may further include multiple hook members 114 having proximal ends 116 and distal ends 118. The proximal ends 116 may have at least one projection (not shown) adapted to engage the positioning channel when the hook members 114 are in extended positions. The front side 106 of the bracket member 104 may be adapted to receive the hook members 114 into the retracting grooves 108 when in a retracted position thereby concealing the hook members 114.

Each of the positioning channels may have a top side and bottom side, thereby providing a cam surface identical to the description of the first embodiment. Each of the projections may be a cam whereby the cam engages the top side or cam surface of each of the positioning channels when each of the hook members 114 is in the extended position and the cam engages the bottom side or cam surface when each of the hook members is in the retracted position.

Each of the retracting grooves 108 each has two sides 130 and has two positioning channels located on either side of each of retracting grooves 108. The hook members 114 may be further defined as arms 134 each having two sides 136, a front side 138 and back side 140, and each having two cams on either side of each of the arms 134 to engage each of the two positioning channels.

Each of the cams engage the top sides of the positioning channels allowing the arms 134 to extend to a maximum of 45°. Additional ribs may be included on the back side of the bracket member 112 to form the positioning channels and the cam surfaces thereby engaging and restricting the cams 142 when in either the extended or retracted positions.

Other variations and modifications of the invention are possible. All such modifications or variations are believed to be within the sphere and scope of the invention as defined by the claims appended hereto.

I claim:

1. A retractable hook assembly to mount on a surface, comprising:

(a) a bracket member having a front side with a retracting groove, said retracting groove has two sides and has two positioning channels located on both sides of said retracting groove, at least one positioning channel having a top side and a bottom side providing a cam surface, and a back side adapted for mounting on said surface; and (b) an arm having two sides, a front side, a back side, a proximal end and a distal end, said proximal end having two cams on both sides of said arm to engage said positioning channels whereby said cams engage said top side or cam surface of said positioning channels allowing said arm to extend to a maximum of 45° when said arm is in an extended position and said cam engages said bottom side or cam surface when said arm is in a retracted position;

wherein said front side of said bracket member is adapted to receive said arm into said retracting groove when in said retracted position thereby concealing said arm.

2. A retractable hook assembly as claimed in claim 1 wherein said back side of said bracket member further comprises a series of ribs providing additional strength to said bracket member.

3. A retractable hook assembly as claimed in claim 2 further comprising additional ribs to form said positioning channels and said cam surfaces, thereby engaging and restricting said cams when in either said extended or retracted positions.

4. A retractable hook assembly as claimed in claim 3 wherein said retractable hook assembly holds up to 35 pounds.

5. A retractable hook assembly as claimed in claim 1 wherein said distal end of said arm is adapted to receive a user's finger thereby allowing said user to extend said arm into said extended position.

6. A retractable book assembly as claimed in claim 5 wherein said distal end of said arm has a pull tab shaped to accommodate said user's finger.

7. A retractable hook assembly as claimed in claim 1 wherein said front side of said bracket member and said front side of said arm includes graphic that is visible when said retractable hook assembly is in said retracted position and said hook member is concealed.

8. A retractable hook assembly as claimed in claim 1 wherein said retractable hook assembly is manufactured from plastic, resin, wood, metal or composite material.

9. A retractable hook assembly as claimed in claim 1 wherein said surface is a wall, door or vertical surface.

10. A retractable hook assembly as claimed in claim 1 wherein said distal end of said arm is hook shaped thereby being parallel to said bracket member when said arm is in said extended position.

11. A retractable hook assembly to mount on a surface, comprising:

(c) a bracket member having a front side with multiple retracting grooves, said retracting grooves each has two sides and two positioning channels located on both sides of each of said retracting grooves, each retracting groove having at least one positioning channel having a top side and a bottom side providing a cam surface, and a back side adapted for mounting on said surface; and (d) multiple arms each having two sides, a front side, a back side, a proximal end and a distal end, said proximal end having two cams on both sides of said arm to engage said positioning channels whereby said cams engage said top side or cam surface of said positioning channels allowing said arms to extend to a maximum of 45° when said arms are in an extended position and said cams engage said bottom side or cam surface when said arms are in a retracted position;

wherein said front side of said bracket member is adapted to receive said arms into said retracting groove when in said retracted position thereby concealing said arms.

12. A retractable hook assembly as claimed in claim 11 further comprising additional ribs to form said positioning channels and said cam surfaces thereby engaging and restricting said cams when in either said extended or retracted positions.

13. A retractable hook assembly as claimed in claim 11 wherein said retractable hook assembly holds up to 35 pounds.

14. A retractable hook assembly as claimed in claim 11 wherein said distal end of said arms are adapted to receive a user's finger thereby allowing said user to extend said arms into said extended position.

15. A retractable hook assembly as claimed in claim 14 wherein said distal end of said arms have pulls tab shaped to accommodate said user's finger.

16. A retractable hook assembly as claimed in claim 11 wherein said front side of said bracket member and said front side of said arm includes graphic that is visible when said retracable hook assembly is in said retracted position and said hook member is concealed.

17. A retractable hook assembly as claimed in claim 11 wherein said retractable hook assembly is manufactured from plastic, resin, wood, metal or composite material.

18. A retractable book assembly as claimed in claim 11 wherein said surface is a wall, door or vertical surface.

19. A retractable hook assembly as claimed in claim 11 wherein said distal end of said arms are hook shaped thereby being parallel to said bracket member when said arms are in said extended position.

* * * * *